US007552554B1

(12) United States Patent
Marquardt et al.

(10) Patent No.: US 7,552,554 B1
(45) Date of Patent: Jun. 30, 2009

(54) DOOR APPLIANCE

(76) Inventors: Wesley P. Marquardt, 7604 Columbus Rd., Fowler, IL (US) 62338; Tyler P. Marquardt, 6128 Hickory Grove North, Quincy, IL (US) 62305

( * ) Notice: Subject to any disclaimer, the term of this patent is extended or adjusted under 35 U.S.C. 154(b) by 0 days.

(21) Appl. No.: 12/019,366

(22) Filed: Jan. 24, 2008

(51) Int. Cl.
*G09F 11/02* (2006.01)
*E06B 7/28* (2006.01)

(52) U.S. Cl. ..... 40/493; 40/495; 49/171

(58) Field of Classification Search ..... 40/495, 40/493, 907; 49/171; 359/504
See application file for complete search history.

(56) References Cited

U.S. PATENT DOCUMENTS

| | | | | | |
|---|---|---|---|---|---|
| 380,652 | A | | 4/1888 | Gartside | |
| 1,255,909 | A | * | 2/1918 | Monasch | 40/495 |
| 2,098,471 | A | * | 11/1937 | Starks | 116/215 |
| 2,902,784 | A | | 9/1959 | Sukul | |
| 3,672,081 | A | * | 6/1972 | Bergeron | 40/495 |
| 4,130,728 | A | | 12/1978 | Grauel | |
| 4,269,474 | A | * | 5/1981 | Kamimura | 359/504 |
| 4,854,061 | A | | 8/1989 | Khoshkish | |
| 4,881,335 | A | * | 11/1989 | Khoshkish | 40/449 |
| 5,718,513 | A | | 2/1998 | Booth et al. | |

FOREIGN PATENT DOCUMENTS

DE 4420090 A1 * 5/1995

* cited by examiner

*Primary Examiner*—Cassandra Davis
(74) *Attorney, Agent, or Firm*—Polster, Lieder, Woodruff & Lucchesi, L.C.

(57) ABSTRACT

An appliance for a room door serves to display a message at both the inside and outside faces of the door and further enables one at the inside face to observe individuals and activities beyond the outside face. The appliance includes an interior unit against the inside face of the door, an exterior unit against the outside face of the door, an operating shaft extending through the door and between the two units, and a viewer that extends through the operating shaft and clamps the units against their respective faces of the door. Each unit has a cover provided with a window and a message wheel, a portion of which is exposed for viewing through the window in its cover. The message wheels are engaged with the operating shaft, so that they rotate in unison and display like messages through the windows in the covers of their respective units.

16 Claims, 4 Drawing Sheets

DOOR APPLIANCE

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

This invention relates in general to appliances for doors and more particularly to a device that displays messages on a door and further affords observations through the door.

In many states the regulations that govern the operation of hotels and motels require that the doors to guest rooms have viewers so that the occupants of such rooms can view through the doors to observe individuals and activities beyond such doors. Each viewer extends through a hole in the door to which it is fitted. Also, hotels and motels commonly provide door cards that are configured to hang from the door handles of guest room doors so as to convey a message such as "Do Not Disturb." Basically, each card has the capacity to convey only two messages—one for each side of the card.

Apart from that, the typical door card is easily dislodged from the handle over which it is placed, particularly when the door is opened or closed. Indeed, the occupant of the room must open the room door to place the card on the handle for the door. Moreover, the card is subject to tampering when displayed at the outside face of the door, or simply becoming lost.

DETAILED DESCRIPTION

Figure 1:
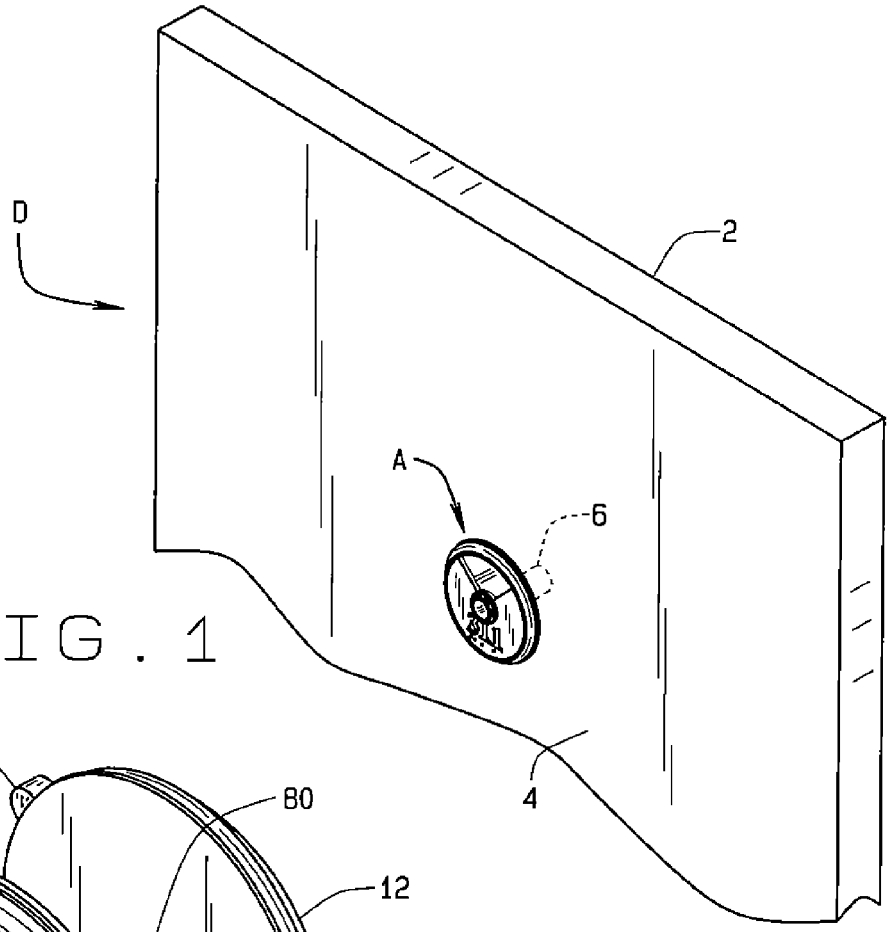
FIG. 1 is a fragmentary view of a room door fitted with a door appliance constructed in accordance with and embodying the present invention.
Figure 2:
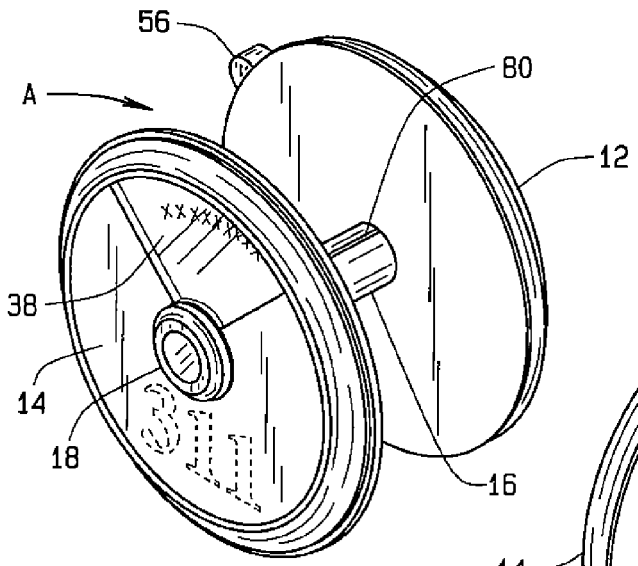
FIG. 2 is a perspective view of the front of a door appliance, with the appliance being removed from the door.
Figure 3:
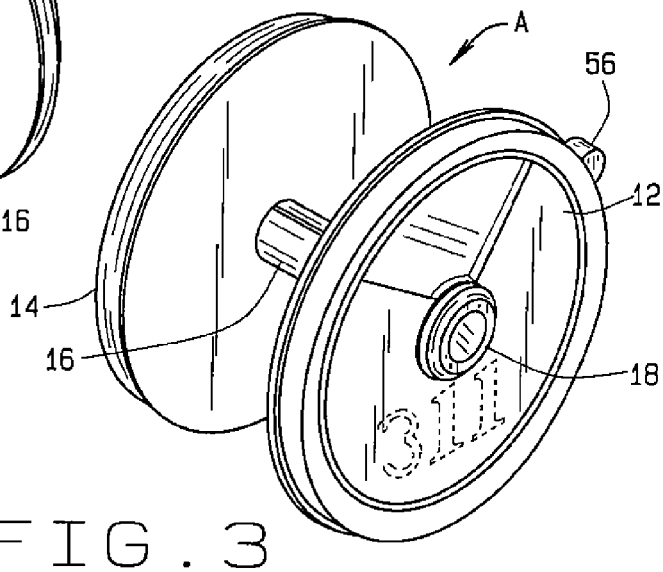
FIG. 3 is a perspective view of the rear of the door appliance removed from the door.

Referring now to the drawings (FIGS. 1-3) a door appliance A serves to display messages on a door D and further enables one to make observations through the door D. It is particularly suited for the doors that control access to guest rooms in hotels and motels. It enables an individual who occupies a guest room to determine who is on the other side of the door D and to display any one of several messages, all while the door D remains closed. Moreover, the message cannot be dislodged or tampered with. The door D has an inside face 2 which is exposed to the room that it normally isolates and an outside face 4 that is exposed to the corridor or other walkway that leads to the room, at least when the door D is closed. In addition, the door D has a hole 6 that lies generally midway between its side edges and extends completely through the door D between its inside face 2 and its outside face 4. The appliance A basically includes interior unit 12 that fits against the inside face 2 of the door D, an exterior unit 14 that fits against the outside face 4 of the door D, an operating shaft 16 that extends through the hole 6 and between the two units 12 and 14, and a viewer 18 that extends through the operating shaft 16 and retains the interior and exterior units 12 and 14 on the door D, all of which are organized along a center axis X.

Figure 4:
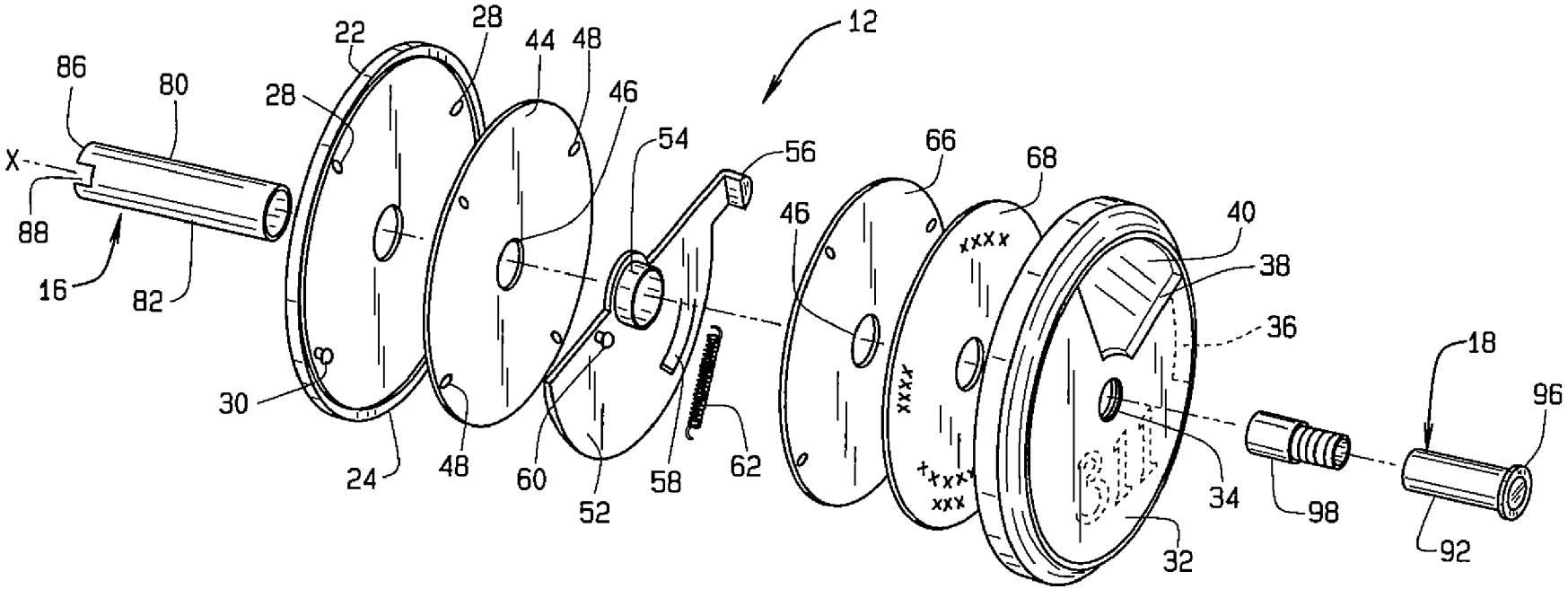
FIG. 4 is an exploded perspective view of the interior unit that forms part of the door appliance.

The interior unit 12 includes (FIG. 4) a back plate 22 that fits against the inside face 2 of the door D. It has a peripheral lip 24 and a center hole 26 that is large enough to loosely receive the operating shaft 16. Near the peripheral lip 24 the back plate 22 has a pair of detents 28 that are located 90° apart. Offset angularly from the detents 28, yet immediately inside the lip 24, is a stud 30 that projects axially away from the door D.

The interior unit 12 also includes a cover 32 that along its periphery snaps into the peripheral lip 24 of the back plate 24. The remainder of the cover 32 lies beyond, yet for the most part parallel to the back plate 22. The cover 32 together with the back plate 22 form a housing that encloses the operating components of the interior unit 12. The cover 32 also has a center hole 34 that is large enough to accommodate the viewer 18, but not the operating shaft 16. Along its peripheral wall the cover 32 has an arcuate slot 36 that extends slightly over 90°. Finally, the cover 32 has an arcuate window 38 that lies between the center hole 34 and the peripheral wall of the cover 32, and it occupies about 90° on the face of the cover 32. The window 38 contains a lens 40 formed from a suitable transparent material.

Among the operating components of the interior unit 12 is a driven disk 44 that lies along the back plate 22 with its peripheral edge located immediately inwardly from the stud 30 that projects from the back plate 22. The driven disk 44 has a center hole 46 that receives the operating shaft 16 and indeed is keyed to the operating shaft 16, so that the driven disk 44 and shaft 16 will rotate in unison. The driven disk 44 also has small apertures 48 arranged at 90° intervals near its periphery. For every 90° of rotation for the driven disk 44, two of its apertures 48 will align with the two detents 28 in the back plate 22, so that at every 90° of rotation for the driven disk 44 the detents 28 stabilized the driven disk 44 in the sense that they impede its rotation. The operating components of the interior unit 12 also include an indexing plate 52 of semicircular configuration. It lies immediately over the driven disk 44 and has a bushing 54 that receives the operating shaft 16. The bushing 54 rotates freely on the operating shaft 16 about the axis X. The semicircular edge of the indexing plate 52 lies inside the stud 30 on the back plate 22, but the indexing plate 52 has an operating lever 56 that projects beyond that edge and through the arcuate slot 36 in the peripheral wall of the cover 32. The indexing plate 52 contains a drive tab 58 that bears against the driven disk 44, and owing to the resiliency of the material from which the indexing plate 52 is formed, the tab 58 at its free end is urged against the disk 44. The free end of the drive tab 58 lies at the same radius as the apertures 48 on the driven disk 44, so that the free end will align with and engage the driven disk 44 at the apertures 48, one at a time, depending on angular disposition of the driven disk 44. Finally, the indexing plate 52 has a stud 60 that projects axially from it. That stud 60 and the stud 30 on the back plate 22 are connected by a tension spring 62 that urges the indexing plate 52 in one direction of rotation and in so doing normally holds the operating lever 56 against one end of the arcuate slot 36 in the cover 32.

Thus, when lever 56 is rotated away from that end of the arcuate slot 36 toward the other end of the arcuate slot 36, against the force of the spring 62, the drive tab 58, being engaged with driven disk 44 at one of the apertures 48 in the driven disk 44, will rotate the driven disk 44 90°. In so doing, two of the remaining apertures 48 will advance with respect to the detents 28 in the back plate 22. The detents 28 hold the driven disk 44 in the new position—indeed, in each position to which it is rotated with an actuation of the operating lever 56. Thus, four actuations of the operating lever 56 will advance the driven disk 44 a full rotation. Of course, with each angular advance of the driven disk 44, the operating shaft 16 rotates a like amount.

In addition to the driven disk 44 and the indexing plate 52, the operating components of the interior unit 12 include a message wheel 66, which despite serving a different function, may be same as the driven disk 44. It too is keyed to and rotates with the operating shaft 16. The message wheel 66 carries a label 68 that has four messages printed on it at 90° intervals, each occupying an arc no greater than the arc occupied by the window 38 in the cover 32. With each 90° rotation of the message wheel 66 a different message comes into view within the window 38. Those messages may include "Do Not Disturb," "Occupied," a call for house keeping, and the like.

Figure 5:
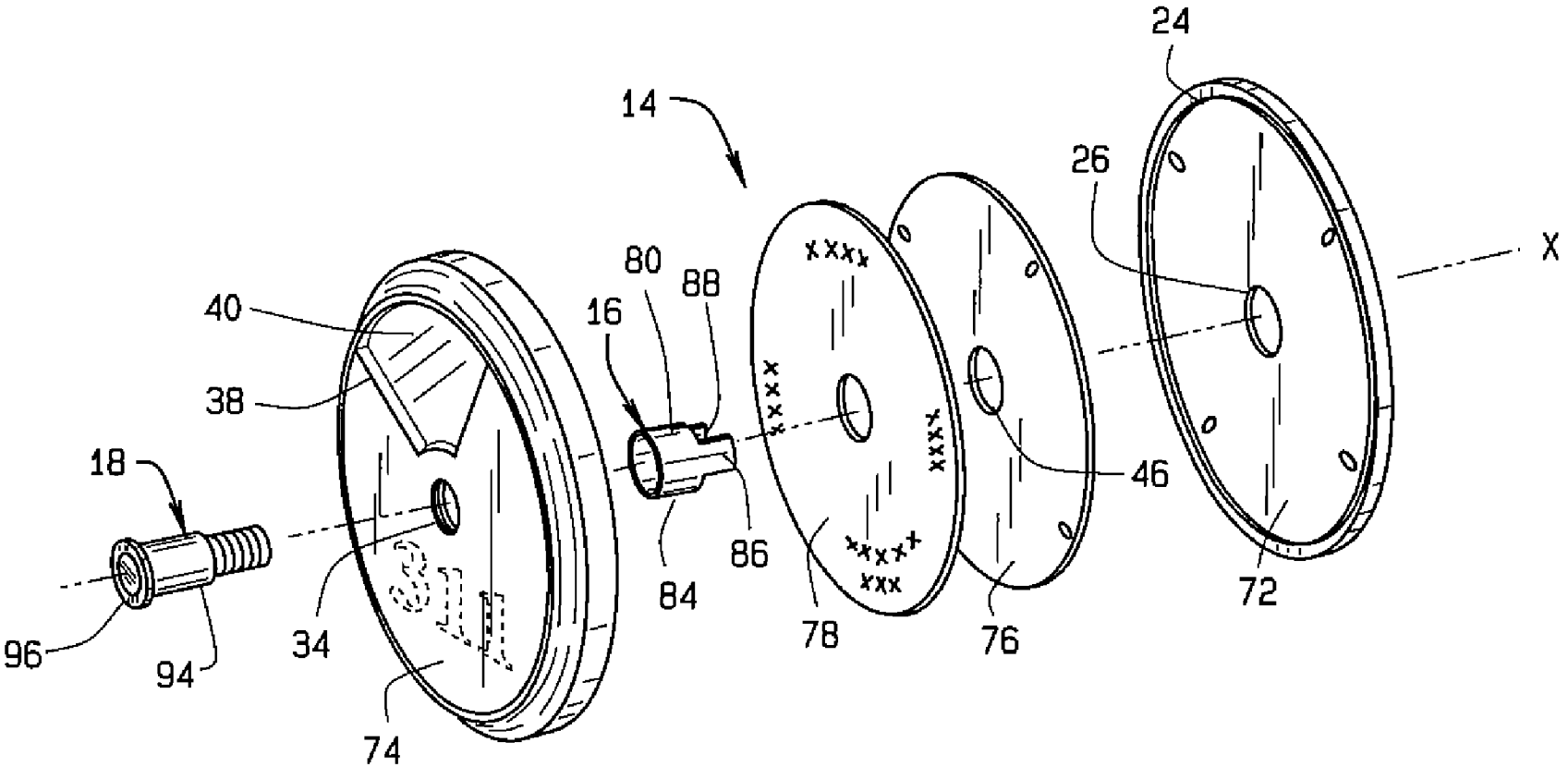
FIG. 5 is an exploded perspective view of the exterior unit that forms part of the door appliance.

The exterior unit 14 is much the same as the interior unit 12, except that it does not include the driven disk 44 or the indexing plate 52. It has (FIG. 5) a back plate 72, a cover 74, a message wheel 76, and a label 78 that are the same as their respective counterparts 22, 32, 66, and 68 in the interior unit 12, although there may be dimensional differences. The operating shaft 16 is keyed to the message wheel 76, so when the message wheel 66 of the interior assembly 12 rotates, so does the message wheel 76 of the exterior unit 14, and the labels 68 and 78 display corresponding messages through the windows 38 in their respective covers 32 and 74.

The operating shaft 16 extends (FIGS. 4 & 5) through the driven disk 44 and the two message wheels 66 and 76, each to which it is keyed along a keyway 80, so that the driven disk 44 and message wheels 66 and 76 will all rotate in unison. It also extends through the bushing 54 in the indexing plate 52, but the bushing 54 can rotate independently on the shaft 16. And, of course, the operating shaft 16 extends through the hole 6 in the door D, although loosely. The shaft 16, however, does not extend through the center holes 34 in the two covers 32 and 74. It is too large. The shaft 16 possesses a tubular configuration, with its inside diameter being large enough to accommodate the viewer 18.

Although the shaft 16 may have a unitary construction—in essence a single tube—preferably it possesses two segments 82 and 84, each of which is hollow. The segment 84 may be captured within the exterior unit 14, whereas the segment 82 should fit into, yet be removable from the interior unit 12. The two segments 82 and 84 align and at their opposing ends have axially directed dogs 86 and notches 88, all configured and arranged such that the notches 88 receive the dogs 86. This enables the two segments 82 and 84 to remain engaged and to rotate in unison and yet accommodate variances in the spacing between the interior and exterior assemblies 12 and 14. The axially directed keyway 80 in the shaft 16 enables the shaft 16 to rotate with the driven disk 44 and message wheel 66 of the interior unit 12 and with the message wheel 76 of the exterior unit 14, each of which has a small key or tab that projects into the keyway 80.

The viewer 18 may be conventional. As such, it has (FIGS. 4 & 5) an inside section 92 and an outside section 94, each provided with a flange 96 at its end. The inside section 92 extends through the center hole in the cover 32 of the interior unit 12 and projects into the hollow operating shaft 16. The outside section 94 extends through the center hole 34 in the cover 74 of the exterior unit 14 and likewise projects into the hollow interior of the operating shaft 16. Within the operating shaft 16—and likewise within the door D—the two sections 92 and 94 are threaded together until their flanges 96 abut the two covers 32 and 74. Thus, the viewer 18 secures the interior and exterior units 12 and 14 against the inside and outside faces 2 and 4 of the door D.

For a door D of having thickness too great for the threads of the two sections 92 and 94 to engage within the door D, the viewer 18 may be provided with an extender 98 (FIG. 4) having both male and female ends. The inside and outside sections 92 and 94 thread onto the extender 96 so that their flanges 98 are farther apart.

The covers 32 and 74 of the interior and exterior units 12 and 14 may carry information such as the number of the room to which the door D controls access, both in Arabic numerals and Braille dots.

To install the door appliance A on the door D, the hole 6 is first drilled completely through the door D at a suitable location, it being large enough in diameter to loosely receive the operating shaft 16. Then the section 82 of the operating shaft 16 is installed into the interior unit 12 by inserting it through the center hole 26 in the back plate 22, through the center hole 46 in the driven disk 44, through the bushing 54 of the indexing plate 52, and finally through the center hole 46 in the message wheel 66. The driven disk 44 and message wheel 66 engage the segment 82 at its keyway 80. The end of the segment 82 bottoms out against the cover 32 of the unit 12. Then the interior unit 12, with the shaft segment 82 projecting from its back plate 22 is brought to the door D and the segment 82 is measured to ensure that it will properly engage the shaft segment 84 when the exterior unit 14 is against the outside face 4 of the door D. If the segment 82 is too long, it is cut off and again installed in the interior unit 12 with the proper length.

Thereupon, the interior unit 12 is placed against the inside face 2 of the door D with its shaft segment 82 projecting into the hole 6 in the door D—indeed, almost for the full thickness of the door D. Next, the exterior unit 14 is brought against the outside face 4 of the door D and maneuvered such that the notches 88 received the dogs 86 on the shaft segments 82 and 84. At this juncture, the messages exposed through the windows 38 of the two units 12 and 14 should be the same.

With the two units 12 and 14 now held manually against the door D, the outside section 94 of the viewer 18 is inserted through the center hole 34 in the cover 74 of the exterior unit 14, whereas the inside section 92 is inserted through the center hole 34 in the cover 32 of the interior unit 12. The two sections 92 and 94 project into the hollow interior of the shaft 16 where their ends encounter each other, whereupon, the one section is rotated relative to the other, so that the two sections 92 and 94 thread together within the shaft 16. This brings flange 96 of the inside section 92 against the cover 32 of the interior unit 12 and the flange 96 of the outer section 94 against the cover 74 of the exterior unit 14. Indeed, the viewer 18 clamps the interior unit 12 against the inside face 2 of the door D and the exterior unit 14 against the outside face 4 of the door D.

The appliance A enables an individual standing at the inside face 2 of the door D, when the door D is closed, to observe individuals and activities immediately beyond the outside face 4 of the door D simply by looking through the viewer 18. If the individual desires to display at the outside face 4 of the door D any one of the messages that are on the two message wheels 66 and 76, the individual moves the operating lever 56 of the indexing plate 52 for the interior unit 12 through the arcuate slot 36 in the cover 32 of that unit 12. The drive tab 58 on the indexing plate 52, being engaged with the driven disk 44 of the interior unit 12 at one of apertures 48 in the driven disk 44, rotates the driven disk 44 for 90° and likewise rotates the message wheel 66 of the interior unit 12 and the message wheel 76 of the exterior unit 14, since the driven disk 44 and the two message wheels 66 and 76 are all engaged with the operating shaft 16 and therefore all will rotate in unison. The rotation brings a new message into the windows 38 of the cover 32 for the interior unit 12 and the cover 74 for the exterior unit 14. Once the operating lever 56 is released, the spring 62 brings the indexing plate 52 back to its initial position and the drive tab 58 on it again engages the driven disk 44, but this time at the following aperture 48 in the driven disk 44. With each advancement of the operating lever 56 through the arcuate slot 36 in the cover 32 of the interior unit 12, the appliance A displays a different message in the windows 38 of the two covers 32 and 74.

The appliance A has the capability of displaying anyone of multiple messages—messages that are not subject to tampering, or dislodgement from the door D, or simply loss. Moreover, the occupant of the room can change the message displayed without leaving the room or even opening the door D.

Figure 6:
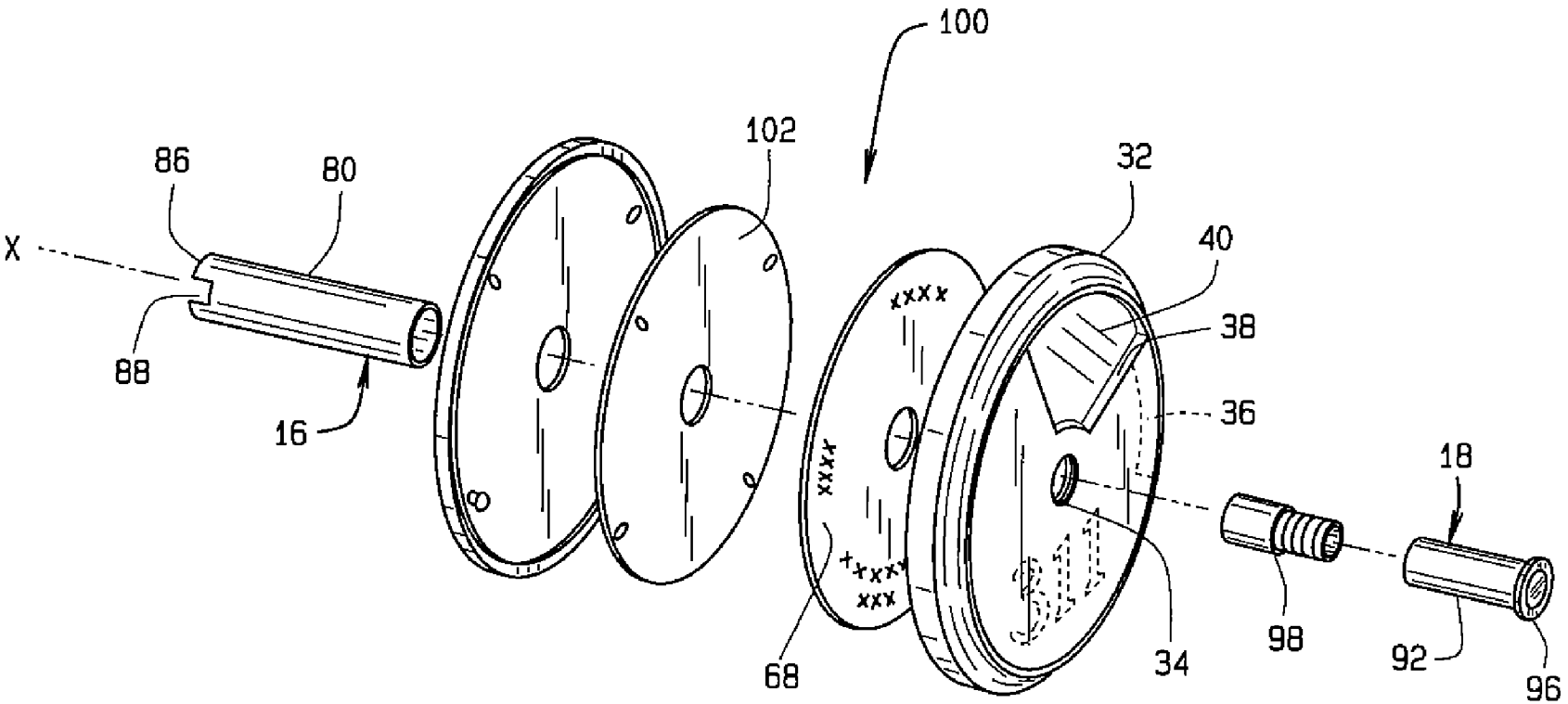
FIG. 6 is an exploded perspective view of an alternate interior unit.

An alternative interior unit 100 (FIG. 6) combines the drive disk 44 and the message wheel 66 into a single disk 102 and eliminates the indexing plate 52 and spring 62. The single disk 102 carries the label 68. Moreover, its peripheral edge is exposed in the arcuate slot 36 of the cover 32, so one can rotate the disk 102 much like a thumb wheel. Of course, when the disk 102 rotates, different messages on the label 68 carried by it appear in the window 38 of the cover 32 for the unit 100 and likewise corresponding messages appear in the window 38 of the cover 74 for the exterior unit 14.

By changing the size of the window 38 in the covers 32 and 74 of the interior and exterior units 12 and 14 as well as the location and spacing of the detents 28 on the back plate 22 of the interior unit 12 and the location and spacing of the apertures 48 in the driven disk 44, more or less messages may be displayed on the message wheels 66, 76, and 102. Also, a machine screw or other clamping element may be substituted for the viewer 18 to hold the interior unit 12 or 100 against the inside face 2 of the door D and the exterior unit 14 against the outside face 4 should one desire to use the appliance A simply for displaying messages without making observations through the door D.

The invention claimed is:

1. An appliance for a room door, said appliance comprising:

an interior unit including a message wheel that carries messages;

an exterior unit including another message wheel that carries corresponding messages;

a hollow operating shaft extended between the units and being engaged with the message wheels, so that the shaft and message wheels will rotate in unison and the message wheels will display like messages; and a viewer extending through the operating shaft and serving to enable one at the interior unit to observe beyond the exterior unit and further serving to prevent the units from separating.

2. An appliance according to claim 1 wherein the interior unit includes a mechanism for rotating the shaft, so that the message wheels can display different messages.

3. An appliance according to claim 2 wherein the interior unit has a cover provided with a slot and the mechanism for rotating the shaft is exposed at the slot.

4. An appliance according to claim 3 wherein the interior unit includes an indexing plate that rotates back and forth through a limited arc about the axis of the shaft and with each rotation in one direction rotates the shaft and message wheels.

5. An appliance according to claim 1 wherein the interior and exterior units have covers provided with windows, and the messages on the message wheels are exposed through the windows.

6. An appliance according to claim 5 wherein the cover of the interior unit has a slot through which the edge of the message wheel for that unit is exposed, so that the message wheel of the interior unit can be rotated by contacting it through the slot.

7. An appliance according to claim 1 wherein the viewer includes sections that thread together within the operating shaft.

8. An appliance according to claim 7 wherein the interior and exterior units have covers through which the viewer extends, and the viewer at its end has flanges that bear against the covers and prevent the units from separating.

9. An appliance according to claim 1 and further comprising means for indexing the shaft.

10. An appliance according to claim 9 wherein the means for indexing the shaft includes a driven disk coupled to the shaft and an indexing plate mounted adjacent to the driven disk for rotation about the axis of the shaft back and forth through a limited arc, the indexing plate having a tab that engages the driven disk for rotation of the driven disk when the indexing plate rotated in one direction and disengages the driven disk when the indexing plate is rotated in the opposite direction.

11. An appliance according to claim 1 wherein the shaft has two segments which engage so that the segments rotate in unison, the one segment being further engaged with the message wheel of the interior unit and the other segment being further engaged with the message wheel of the exterior unit.

12. In combination with a room door having inside and outside faces and a hole extending through it and opening out of it at the faces, an appliance for displaying messages on the door and for making observations through the door, said appliance comprising:

an interior unit mounted against the inside face of the door and having a message wheel and a cover provided with a window through which a segment of the message wheel is exposed for viewing;

an exterior unit mounted against the outside face of the door and having a message wheel and a cover provided with a window through which a segment of the message wheel is exposed for viewing;

a tubular operating shaft located within the hole in the door and projecting beyond the inside face of the door into the interior unit where it is engaged with the message wheel of the interior unit and further projecting beyond the outside face of the door and into the exterior unit where it is engaged with the message wheel for the exterior unit; and a viewer extended through the tubular shaft for providing observations through the door and clamping the interior and exterior units against the inside and outside faces of the door.

13. The combination according to claim 12 wherein the viewer has sections, each provided at one end with a flange and at its other end with a thread; and wherein the sections at their other ends thread together within the operating shaft and the flanges bear against the covers to clamp the units against the faces of the door.

14. The combination according to claim 13 wherein the cover of the interior unit has a slot through which rotation of the message wheel and shaft is effected.

15. The combination according to claim 13 wherein the interior unit includes an indexing plate that rotates back and forth about the axis of the shaft through a limited arc and in one direction of rotation rotates the shaft about the axis and in the other direction returns without rotating the shaft.

16. The combination according to claim 12 wherein the shaft has two segments which engage so that the segments rotate in unison, the one segment being further engaged with the message wheel of the interior unit and the other segment being further engaged with the message wheel of the exterior unit.

* * * * *